United States Patent [19]

Karger

[11] Patent Number: 4,565,011

[45] Date of Patent: Jan. 21, 1986

[54] AUTOMATICALLY RETRACTABLE CHALK LINE ASSEMBLY

[76] Inventor: Kim Karger, 4034 S. Joliet Ave., Lyons, Ill. 60534

[21] Appl. No.: 636,115

[22] Filed: Jul. 30, 1984

[51] Int. Cl.[4] ..... B44D 3/38

[52] U.S. Cl. ..... 33/414; 242/107

[58] Field of Search ..... 33/414, 413, 138, 1 LE; 242/107, 107.5

[56] References Cited

U.S. PATENT DOCUMENTS

| | | | |
|---|---|---|---|
| 627,057 | 6/1899 | Gavin | 33/414 |
| 754,827 | 3/1904 | Thompson | 33/414 |
| 845,401 | 2/1907 | Field | 33/414 |
| 2,530,114 | 11/1950 | Bugg et al. | 242/107 |
| 2,589,500 | 3/1952 | Landon et al. | 33/414 X |

*Primary Examiner*—William D. Martin, Jr.
*Attorney, Agent, or Firm*—Balogh, Osann, Dvorak, Kramer, Genova & Traub

[57] ABSTRACT

Automatically retractable chalk line assembly, including a housing having a pair of compartments, one of the compartments containing a spool having wound thereon a chalk line, and further containing a quantity of powdered chalk bathing the spool and line. The line passes outwardly of the compartment through a wiping member which removes excess chalk from the line. The other compartment houses a gear arrangement one side of which is connectable with a spur gear mounted on the spool and the other side connectable to a retractable assembly which includes a helical spring for applying rotational movement to the spool. The other end of the spool is connectable to a brake drum which immobilizes the spool from retracting until it is released by the brake drum upon actuation of a lever. The retractable assembly is provided with means for preventing the overwinding of the helical spring in the event that an abnormal amount of line is withdrawn from the chalk line assembly.

7 Claims, 4 Drawing Figures

AUTOMATICALLY RETRACTABLE CHALK LINE ASSEMBLY

BACKGROUND OF THE INVENTION

1. Field of the Invention

The invention relates to a chalk line device containing a spool of line which passes through a chamber filled with powdered chalk, the device being capable of being used as a chalk line assembly.

2. Description of the Prior Art

Chalk line devices are used for striking lines by carpenters, bricklayers, and various other artisans for the purpose of marking straight lines upon rough or irregular surfaces.

The field of chalk line devices is well developed, and many types and forms are available on the market. For example, U.S. Pat. No. 1,208,068 describes a device having a chalk line reel for holding a chalk line, the device comprising a frame for supporting the chalk line reel, the frame being constructed to provide a receptacle for containing pulverized chalk, and the line passing through the receptacle so that the line may be covered with the chalk as the line is drawn out. A spring is included in the frame and is coupled to a shaft supporting the reel so that after a portion of the chalk line is drawn out, the spring is tensioned so that upon release of the chalk line, the withdrawn portion of the chalk line is rewound on the reel. One disadvantage of this type of chalking device is that no provision is made for immobilizing the wound spring after a predetermined length of the chalk line is withdrawn, otherwise, as soon the chalk line is released, it is drawn immediately into the frame by the tensioned spring.

Another form of a chalk line device is described is U.S. Pat. No. 4,192,078, wherein the device is provided with a locking mechanism for restraining a chalk line against the tension of the spring when a portion of the chalk line is withdrawn from the device.

The main disadvantage of the chalk line devices described in the foregoing two references, as well as other types of retractable-type chalk line devices, is of the limitation imposed by the physical constants of the springs used for retracting the chalk line into the interior of the devices. In other words, only a predetermined length of chalk line can be withdrawn from a device. After the spring is wound to its utmost, no further withdrawal of chalk line can occur. Therefore, the length of the line is limited by the spring.

SUMMARY OF THE INVENTION

To overcome the foregoing disadvantage of having the length of the chalk line limited by the size and construction of the spring, an improved type of chalk line device is provided using a retractable assembly which can be released to enable further withdrawal of the chalk line to any extent desirable by the user. The retractable device can be manually actuated to impart additional tensioning to the spring to actuate the reel to rewind additional lengths of the chalk line which has been withdrawn beyond the initial capability of the spring to wind up the line on the reel. The retractable assembly is provided with an automatic release so that after the spring has been wound up to its utmost, further lengths of chalk line can be withdrawn without imposing additional tension on the spring.

DESCRIPTION OF THE PREFERRED EMBODIMENT

Figure 1:
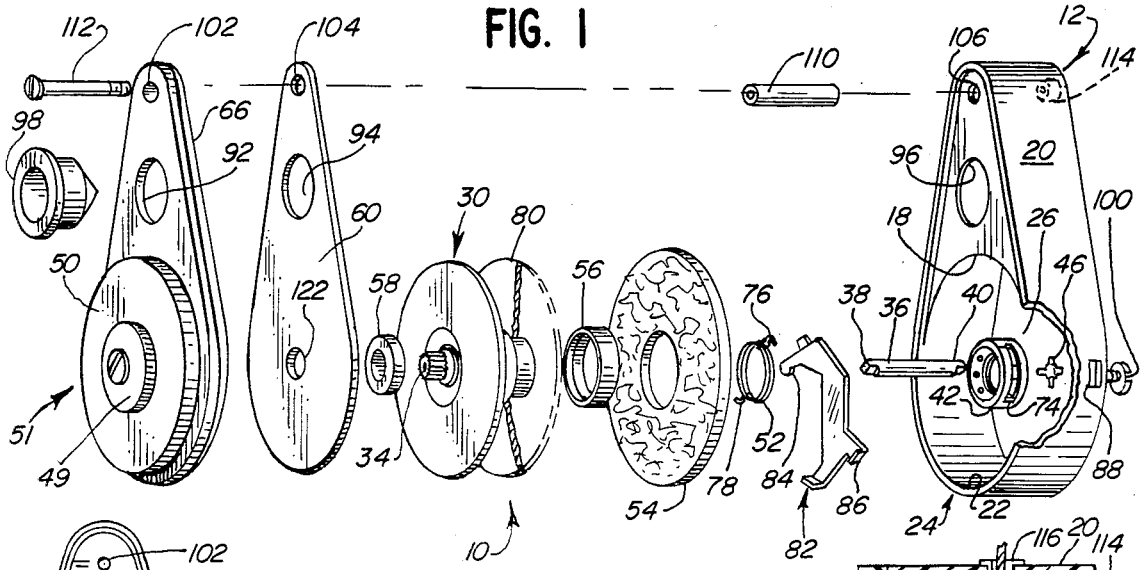
FIG. 1 is an exploded pictorial view of the components comprising a chalk line assembly.
Figure 2:
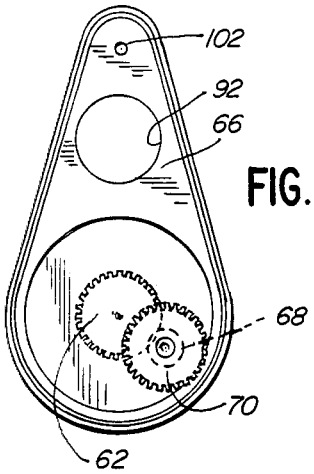
FIG. 2 is an inner view of a retractable assembly containing a gear arrangement.

As shown particularly in FIG. 1, a chalk line assembly 10 comprises a housing 12 having a tear shape and having a bottom 14 spaced from a partial wall 16 having a semicircular contour 18. The spacing between the bottom 14 and the partial wall 16 is established by a circumscribing wall 20 which has a semicircular contour portion 22 which, in conjunction with the semicircular contour 18, defines a circular opening 24 defining an entry into a compartment 26 adapted to receive a spool assembly 28, as will be described shortly.

Figure 3:
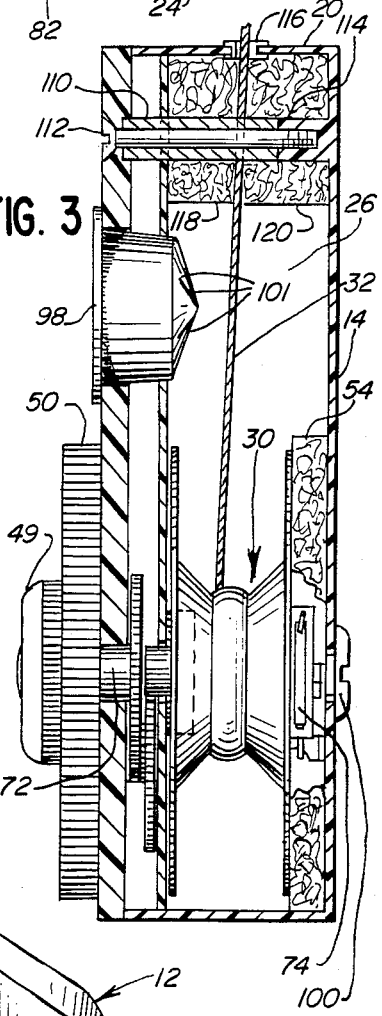
FIG. 3 is a sectional, enlarged view of the chalk line assembly.
Figure 4:
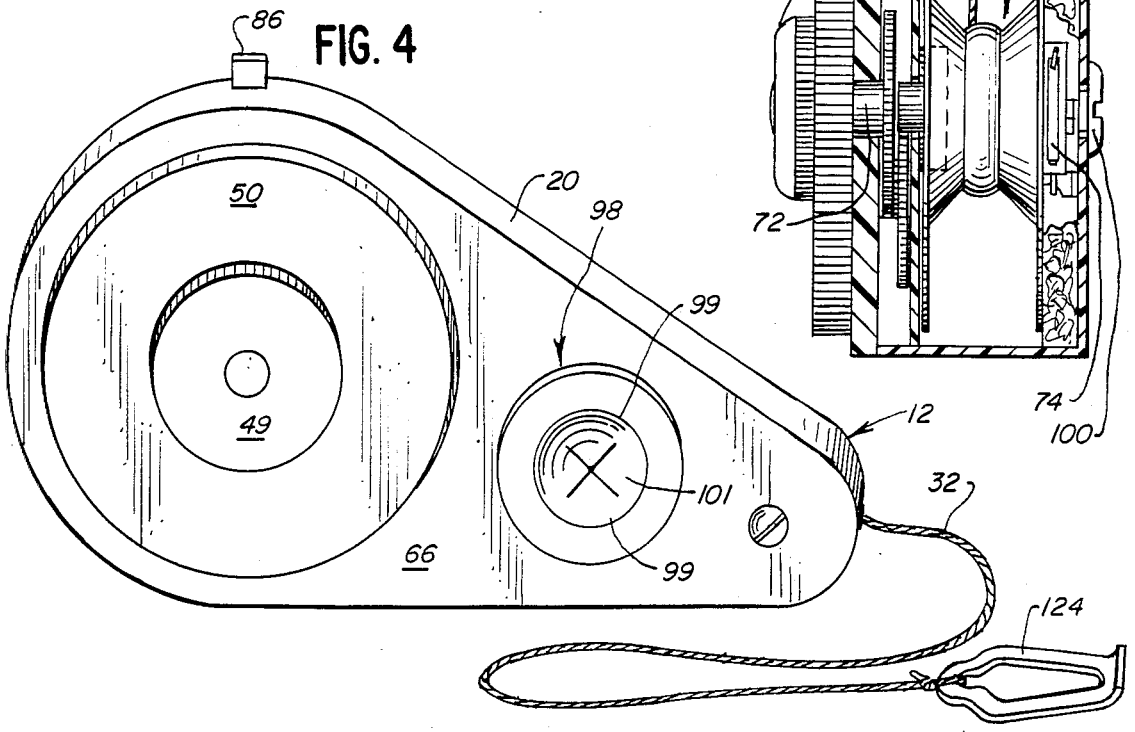
FIG. 4 is a pictorial view of the chalk line assembly with a chalk line extending outwardly.

The spool assembly 28 comprises a spool 30 for receiving thereon a chalk line 32 (FIGS. 3 and 4). The spool 30 is supported on a hollow spool gear 34 which is rotatably supported on a shaft 36 having key portions 38 and 40. The key portion 40 is adapted to fit into a complementary portion (not shown) in a drum housing 42 which has a lobe-shaped protuberance (not shown) adapted to be non-rotatably secured in a complementary lobe-shaped opening 46 in the bottom 14 of the housing 12. The key portion 38 of the shaft 36 is adapted to engage a complementary key opening (not shown) in a spring tension release cap 49 in a retractable assembly 51. The retractable assembly 51 is a conventional device which is commercially available. As best viewed in FIG. 1, the shaft 36 passes through a brake coil spring 52, a spool seal 54, a brake drum seal 56, the hollow spool gear 34, a hollow spool gear seal 58, a separator wall 60, and through a spring drive gear 62 of a gear arrangement 64 for engagement with a drive spring cap 50. The gear 62 forms a part of the gear arrangement 64 which is supported on a gear plate 66. The gear arrangement 64 also includes a spur gear 68 (shown in phantom) attached to one side of a gear 70. The spring drive gear 62, as best viewed in FIG. 3, is supported by a bushing 72 which extends into the interior of the drive spring cap for engagement with a drive spring (not shown) inside the drive spring cap 50. As thus described, when the outer end of the spring (not shown) contained in the cap 50 is wound up by turning the cap 50 in one of the directions, a driving force will be applied by the inner end of the spring to the spring drive gear 62 which, in turn, drives the spur gear 68 and the attached gear 70 which is in engagement with the hollow spool gear 34 to thereby apply a rotational movement to the spool 30.

The drum housing 42 has a slot 74 to accommodate an end 76 of the brake coil spring 52 so that when the brake coil spring 52 is inserted into the drum housing 42, the end 76 will extend outwardly in the slot 74 while the other end 78 of the spring 52 will be secured in one of the holes 79 located opposite to the slot 74. As shown in FIG. 1, there is a series of holes 79 in the drum housing 42 so that an adjustment of tightness of the spring 52 can be made about the drum 77 attached on the outside of the spool flange 80. As shown in FIG. 1, the brake coil spring 52 is wound in a particular direction so that when the end 76 is actuated in a clockwise direction, the inner diameter of the brake coil spring is slightly increased to thereby release a drum 77 attached on the outside of a spool flange 80. For actuating the end 76 on the brake coil spring 52, a lever 82 is provided, the lever having a protuberance 84 adapted to be in constant engagement with the end 76 on the brake coil spring 52. Thus, when the lever 82 is operated, the end 76 of the spring 52 will be moved from one end of the slot 74 to the other to release its grip on the drum 77.

With the arrangement just described, the rotation of the spool 30 is restrained in clockwise direction unless the lever 82 is operated to enlarge the interior opening in the brake coil spring 52 to thereby loosen its constriction on the brake drum (not shown) attached coaxially to the side of the spool flange 80. The lever 82 has an arm 86 which extends outwardly of the circumscribing wall 20 through a slot 88.

The conventional retractable assembly 51 is provided with the spring tension release cap 90 so that the spring (not shown) contained in the cap 50 can be released to assume an untensioned state.

For providing access into the compartment 26, the gear plate 66, the separator wall 60, and the partial wall 16 are provided with openings 92, 94, 96, respectively, the openings being aligned coaxially and adapted to be closed by a removable, flexible plug 98 having a central depressed area 99 formed by abutting segments 101 which will spread apart when a nose (not shown) of a container (not shown) filled with powdered chalk is inserted to introduce the powdered chalk into the compartment 26. In the alternative, the plug 98 may have a solid depressed area 99 (with no segments) so that the plug would have to be removed for filling purposes. The key portion 40 of the shaft 36 is provided with a threaded opening (not shown) for receiving a lock screw 100, as shown in FIG. 3. Thus, the drum housing and the shaft 36 are firmly secured to the bottom 14 by the lock screw 100.

The gear plate 66, the separator wall 60, the partial wall 66, and the bottom 14 are provided with holes 102, 104 and 106, respectively, for accepting a combination of a hollow bushing 110 and a bolt 112, the hollow bushing 110 extending between gear plate 66 and a threaded boss 114 secured to the bottom 14, as best viewed in FIG. 3. The bolt 112 passes through the hole 102 in the gear plate 66 and the bushing 110 to be secured into the boss 114. The chalk line 32 passes outwardly of the housing 12 through a ferrule 116 secured to the circumscribing wall 20. To prevent the chalk inside the compartment 26 from falling through the opening in the ferrule 116, and also to remove excess chalk from the line 32, there are provided two wiping seals 118 and 120 coaxially supported on the hollow bushing 110 and slightly compressed between the separator wall 60 and the bottom 14.

Since the compartment 26 contains powdered chalk, the spool seal 54 prevents the powdered chalk from working inwardly toward and enveloping the drum housing 42 and the brake coil spring 52 inside the drum housing 42. For additional protection, the brake drum seal 56 also assists in preventing the intrusion of the powdered chalk into the interior of the drum housing 42. The gear seal 58 surrounds the hollow spool gear 34 and is compressed between the spool 30 and the separator wall 60 so that no powdered chalk escapes through a hole 122 in the separator wall 60. The free end of the line 32 is provided with a slotted ring 124.

To use the chalk line assembly 10, the user will grasp the ring 124 and pull outwardly the line 32 to a desired length. While this is occurring, the process of pulling outwardly the line 32 will cause the spool 30 to rotate and impart a rotational movement to the gear arrangement 64 to apply a tensioning force to the spring inside the drive spring cap 50. After the chalk line 32 has been snapped by the user, and it is desired to retract the line 32 into the chalk line assembly 10, the lever 82 is pushed inwardly of the housing 12 to thereby release the restraining force applied to the spool 30 so that it is free to rotate as the spring inside the cap 20 begins to unwind.

If an unusually long line 32 is pulled out of the chalk line assembly 10, a limit will be reached on the spring within the cap 52. The retractable assembly is provided with a slip arrangement so that further pulling out of the line 32 will cause clippage of the spring. After an abnormal length of line 32 is pulled outwardly of the chalk line assembly, the spring inside the cap 50 will be capable of rewinding a predetermined length of the line. After the energy of the spring inside the cap 50 is expended, the remaining portion of the unwound line 32 can be retrieved by winding the spring within the cap 50 by rotating the cap 50 to apply internal tension to the spring. After this is completed, the lever 82 is worked again and the remaining portion of the line 32 will be completely retracted.

Although the present invention has been described in reference to a particular embodiment, it is to be understood that minor changes or modifications are possible without departing from the spirit and scope of the present invention as set out in the appended claims.

I claim:

1. A chalk line assembly in combination with an automatically retractable assembly, comprising:

a housing having a bottom;

a separator wall spaced from said bottom and defining a powdered chalk compartment, said separator wall having an opening defining an entry into the interior of said chalk compartment, said retractable assembly having a gear plate spaced from sid separator wall and defining a gear compartment for housing a gear arrangement, said gear plate having an opening defining an entry into the interior of said gear compartment;

a spool assembly including a spool disposed in said chalk compartment, shaft means coupled between said retractable assembly and said bottom for rotatably supporting said spool means, brake means associated with said shaft means for controlling the rotational movement of said spool;

a lever connectably secured to said brake means and having an arm extending exteriorly of the housing for releasing brake action imposed by said brake means on said spool, said means for shielding said gear arrangement and said brake means for the powdered chalk, said entries being coaxially aligned and defining an access into the interior of said chalk compartment for the introduction of said powdered chalk;

a removable plug for closing both of said entries;

a chalk line wound on said spool and extending exteriorly through a hole in a narrowed portion of said housing, chalk wiping means compressed about said chalk line for limiting the amount of chalk adhering to the chalk line, said retractable assembly having a spring which is wound as the chalk line is pulled out of the housing, means associated with said retractable assembly for preventing overwinding of said spring, and means for securing said retractable assembly and said separator wall to said housing.

2. An assembly according to claim 1, wherein one side of the spool is provided with a spur gear for engaging with the gear arrangement and the other side is engageable with said brake means.

3. An assembly according to claim 1, wherein said brake means comprises a brake drum having a base provided with an exteriorly extending lobe-shaped projection, said bottom having a lobe-shaped opening for receiving said lobe-shaped projection, a partial slot extending along a peripheral wall of said drum, a helical spring disposed inside said drum and coaxially disposed about a portion of said spool, said spring having looped ends extending outwardly of said slot and a lever engaging one of said ends and adapted to enlarge the inner diameter of said spring to loosen the engagement of said spring with said portion of said spool.

4. An assembly according to claim 3, wherein said base has a concentric lobe-shaped opening, said shaft means having a shaft provided with lobe-shaped ends, one of said ends being provided with a threaded opening and receivable in said lobe-shaped opening in said base, and a screw for securing said shaft end and said drum to said bottom.

5. An assembly according to claim 1, wherein said retractable assembly comprises a drive spring cap for housing and winding a helical drive spring, and means for providing slippage to one end of said spring to prevent overwinding.

6. An assembly according to claim 1, including a spring tension release cap coupled to said drive spring cap for releasing the tension on the spring, whereby said chalk line assembly can be stored with an untensioned spring.

7. An assembly according to claim 4, wherein the other lobe-shaped end of said shaft extends into a drive spring cap for engagement with a helical drive spring, whereby rotation of said cap will apply tension to said drive spring so that an additional length of the chalk line can be retracted after the initial tensioning of said spring by withdrawal of the chalk line has been expended.

* * * * *